US005129760A

United States Patent [19]

Ropkins

[11] Patent Number: 5,129,760

[45] Date of Patent: Jul. 14, 1992

[54] FORMING A PASSAGEWAY THROUGH THE GROUND

[75] Inventor: John W. T. Ropkins, Orpington, England

[73] Assignee: AEB Jacked Structures Limited, England

[21] Appl. No.: 620,461

[22] Filed: Nov. 29, 1990

[30] Foreign Application Priority Data

Dec. 7, 1989 [GB] United Kingdom ..... 8927648

[51] Int. Cl.[5] ..... E21D 9/04

[52] U.S. Cl. ..... 405/138; 405/149

[58] Field of Search ..... 405/132, 134, 138, 149, 405/150

[56] References Cited

U.S. PATENT DOCUMENTS

| | | | |
|---|---|---|---|
| 440,576 | 11/1890 | Radcliffe | 405/138 |
| 902,973 | 11/1908 | Knudsen | 405/138 |
| 2,021,313 | 11/1935 | Kotrbaty | 405/150 |
| 3,833,960 | 9/1974 | Herth et al. | 14/77 |
| 3,999,394 | 12/1976 | Eberhardt | 405/149 |
| 4,009,579 | 3/1977 | Patzner | 405/138 |
| 4,365,913 | 12/1982 | Bonvoisin | 405/132 |
| 4,929,123 | 5/1990 | Lunardi | 405/150 |

FOREIGN PATENT DOCUMENTS

| | | | |
|---|---|---|---|
| 245155 | 11/1987 | European Pat. Off. . | |
| 309739 | 4/1989 | European Pat. Off. . | |
| 1247221 | 8/1967 | Fed. Rep. of Germany | 405/149 |
| 1658595 | 9/1971 | Fed. Rep. of Germany . | |
| 2021839 | 11/1971 | Fed. Rep. of Germany | 405/138 |
| 2148366 | 4/1973 | Fed. Rep. of Germany . | |
| 2219567 | 10/1973 | Fed. Rep. of Germany . | |
| 2829712 | 11/1979 | Fed. Rep. of Germany | 405/149 |
| 3042942 | 6/1982 | Fed. Rep. of Germany . | |
| 1146205 | 3/1969 | United Kingdom . | |
| 1154707 | 6/1969 | United Kingdom . | |
| 1313575 | 4/1973 | United Kingdom . | |
| 1463632 | 2/1977 | United Kingdom . | |
| 2185277 | 7/1987 | United Kingdom . | |

*Primary Examiner*—Randolph A. Reese
*Assistant Examiner*—John A. Ricci
*Attorney, Agent, or Firm*—Silverman, Cass & Singer, Ltd.

[57] ABSTRACT

A method of forming a passageway (P) through the ground by inserting into the ground a structure (1) comprising a superstructure (3) and a substructure (2). The superstructure (3) is inserted into position in the ground, and the substructure (2) is urged into the ground beneath the superstructure (3), the ground being excavated as the substructure is inserted so as to form the passageway (P) bounded by the superstructure and the substructure.

13 Claims, 3 Drawing Sheets

FORMING A PASSAGEWAY THROUGH THE GROUND

The invention relates to forming a passageway through the ground, and especially to inserting into the ground a structure that defines the boundaries of the passageway, the ground being excavated to accommodate the structure and provide the passageway. Such a method can be used in the construction of tunnels, culverts, underpasses, substructures for bridges and the like.

It is often required to form a passageway underneath an existing installation such as a road or railway to provide, for example, either a pedestrian or vehicular underpass, and it is highly desirable that the normal functioning of such an installation be disrupted as little as possible during that process. It has previously been proposed to form such a passageway by inserting a tubular member axially into the ground in a substantially horizontal direction underneath the installation and removing ground material from the interior of the tubular member. Such a method has the advantage that the road or railway can be kept open to traffic throughout the process, albeit with a maximum speed limitation imposed while the process is being carried out and for a period of time thereafter in case significant ground settlement occurs.

When such a method is used to provide a passageway under an existing installation at only shallow depths beneath it, however, problems can arise owing to instability of the ground. It has previously been proposed in the case of a railway installation to place a grillage of steel girders directly beneath the railway track before the tubular member is inserted. In order to form the grillage, each steel girder is inserted separately, and, while each such insertion is carried out, it is necessary to stop the normal functioning of the railway. Also, it is generally necessary for the grillage to extend over a considerably larger area of ground than the portion to be occupied by the tubular member in order to safeguard the installation during the subsequent insertion of the tubular member. After insertion of the tubular member, the grillage has to be removed by withdrawing the steel girders separately while the normal functioning of the railway is halted again. The process of inserting and removing the grillage can accordingly be an expensive, time-consuming and disruptive operation.

The invention provides a method of forming a passageway through the ground by inserting into the ground a structure which comprises a superstructure and a substructure, wherein the superstructure is inserted into position in the ground, and the substructure is urged into the ground beneath the super-structure, the ground being excavated as the substructure is inserted so as to form a passageway bounded by the superstructure and the substructure.

With the method of the invention, the ground may be excavated for the superstructure before the insertion of the superstructure commences. The excavation may be carried out from the surface to such a level, and over such an area, that the superstructure can then be moved into position without further substantial excavation (although some adjustment of the level may be necessary on insertion). In such a method, which is known as "open cut", the superstructure is advantageously moved into position by urging it using, for example, jacking means. It may, however, in certain circumstances, be practicable to lower the superstructure into position, and this may be done using lifting means such as a crane or cranes. An open cut method does, of course, involve stopping any road or rail traffic on an installation beneath which the passageway is to be formed while a portion of the installation, for example, a length of railway track and associated ballast, is removed, the excavation of the ground and the insertion of the superstructure take place, and the portion of the installation is replaced. The duration of such a stoppage may be reduced if, as is advantageous when it is practicable to do so, at least a part, for example, some or all of the ballast, of a replacement portion of the installation is laid upon the superstructure prior to insertion.

Alternatively to the open cut method, the superstructure may be urged into the ground while the ground is being excavated using a so-called "mining" technique. With such a method, the superstructure may be urged forward continuously (although not necessarily under a constant force) as the excavation is being carried out, or the excavation may be carried out in stages, the superstructure being urged forward intermittently after each stage of the excavation is completed. In each case, the functioning of an installation beneath which the superstructure is being inserted can continue and, generally, road or rail traffic need not be stopped but (if it is necessary at all) merely subjected to a speed restriction.

The choice between using an open-cut or a mining technique for the insertion of the superstructure beneath an installation will depend on the circumstances of the case, mainly on the depth at which the passageway is to be formed beneath the installation, but also on factors such as the condition and composition of the ground, and also on the topography of the ground. It may in some circumstances cause less disruption to close an installation completely for a short period while an open-cut method is used, for example, with a railway over a week-end period, rather than to impose a speed restriction for a longer period required for the insertion of the superstructure by mining, but an open-cut method is generally only practicable when the depth of the passageway to be formed beneath the installation is not great.

With either of the above methods of inserting the superstructure, the substructure, can be inserted by urging the substructure into the ground while excavating beneath the superstructure using a mining technique. That may be carried out by urging the substructure forward continuously (although not necessarily under a constant force) as the excavation is being carried out, or by carrying out the excavation in stages and urging the substructure forward intermittently after each stage of the excavation is completed. It is generally preferred for the substructure to be inserted after the superstructure is in position. In certain circumstances, however, it may be possible, and preferred, to urge the substructure into the ground while the superstructure is being urged into the ground but with the superstructure ahead of the substructure.

Advantageously, the superstructure is arranged to form the roof of the passageway and the substructure is arranged to form the walls and floor of the passageway. Thus, the superstructure may be substantially flat and the substructure substantially U-shaped in cross-section. The substructure may, however, have, in addition, one or more further walls extending parallel to, and between, the two side walls of the U-shape, dividing the substructure into two or more longitudinally-extending portions in order to form two or more parallel passageways.

After its insertion, the superstructure protects the ground immediately above it, and/or an installation above it, from disturbance while the substructure is being inserted. Further, the superstructure can also provide stability to the ground beneath it, and especially to the mining face in front of the substructure, during the excavation process for the insertion of the substructure. The superstructure can effectively isolate the ground beneath it from the effect of changes occurring in or on the ground above it and/or on the installation, for example, changes caused by additional or varying loading on the ground or, in the case of a railway installation, when a train runs on the installation. The angle of repose of the mining face (that is to say, the maximum angle to the horizontal at which the face is stable without being supported in any other manner) can be substantially increased especially at shallow depths by the presence of the superstructure to such an extent that, assuming suitable ground conditions, no other means of supporting the face need be provided during excavation for the insertion of the substructure.

In order to give further protection to the ground, it may be advantageous for the superstructure to be of greater length (in the direction of insertion of the substructure) than the substructure. Thus, the superstructure may be provided with one or more extension members that extend forwardly or rearwardly (in the direction of insertion of the substrucure) of the superstructure. Such extension members may be attached before or after insertion of the superstructure and may, if desired, be removed after insertion of the substructure. The provision of such extension members may be advantageous in circumstances in which it is wished to protect against disturbance of the ground immediately ahead of the final position of the substructure. The or each extension member may be in the form of one or more beams secured to the superstructure.

The substructure should generally be provided, before insertion, with cutting means at its leading end for cutting into the ground as the substructure is urged forwards. Such cutting means also serves to accommodate one or more operators and/or mining machines to carry out the required excavation. Previously, on insertion of tubular members using mining techniques, without the use of a grillage as referred to above, it has been necessary to provide cutting means at the leading end of the tubular member in the form of a complex cutting shield arrangement having a network of supports for the mining face. Such a support network effectively divides the mining face into several smaller faces which have to be mined individually. With the arrangement of the invention, however, because of the presence of the superstructure above the mining face, the cutting means need not always be of such complex form. Thus, it may only be necessary for the cutting means to consist of a cutting blade arrangement around the edge of the leading end of the substructure without other support for the mining face. With a substantially U-shaped substructure, the cutting blade arrangement preferably comprises one or more cutting blades arranged around the base and each side wall of the substructure. In such an arrangement, the entire mining face is available for a single mining operation by, for example, one or two mining machines. Mining can then be carried out more rapidly than when it has to be carried out separately on different portions of the face, and can be considerably facilitated when excavation of obstructions such as brickwork or rock has to be carried out.

Advantageously, there is provided, at least during the insertion of the substructure, means for supporting the superstructure on the substructure that allows relative longitudinal sliding movement between the substructure and the superstructure. The superstructure is then supported partly on the ground beneath it and partly (and to an increasing extent as the insertion of the substructure proceeds) by the supporting means on the substructure. Preferably, the supporting means is adjustable to vary the elevation of the superstructure, so as to allow the superstructure to be maintained at its correct elevation during the insertion of the substructure. If any settlement of the ground occurs during or after insertion of the superstructure causing the elevation of the superstructure to change, the elevation can be corrected on insertion of the substructure. Similarly, further adjustments to the elevation of the superstructure can be made, if necessary, after insertion of the substructure, so that changes in the elevation of the superstructure arising from, for example, ground settlement after insertion of the substructure, can also be corrected. The supporting means may comprise mechanical or hydraulic jacks provided with skids, which may be located in pockets in the substructure, and longitudinally-extending skid paths located on the lower surface of the superstructure. When the substructure is fully inserted beneath the superstructure and there is little or no risk of any further ground settlement arising from the insertion of the substructure, the jacks and skids may be removed and replaced with permanent bearings. The joint between the substructure and the superstructure may be filled with a suitable filler material, if desired, and may then be sealed to prevent water ingress.

The substructure and the superstructure, when it is to be urged rather than lowered into position, should advantageously each be arranged prior to insertion with their longitudinal axes extending substantially horizontally and in the direction of insertion, and each of them can then be inserted by urging in a direction along the longitudinal axis, preferably using jacking means. It will usually be necessary to prepare the ground at the site prior to insertion, and such preparatory work may well include excavation to form a working pit on one side of the installation, in which the superstructure and substructure can be arranged and inserted as described above. A reception pit on the other side of the installation may also be formed. For the first step of inserting the superstructure, the working pit may initially be formed so that its base is at the level at which the superstructure is to be inserted into the ground. With that arrangement, the superstructure is supported directly on the base of the working pit before insertion. After insertion of the superstructure, the working pit may be deepened to accommodate the substructure at the level at which it is to be inserted into the ground. Alternatively, the working pit may initially be formed to accommodate the substructure and the superstructure supported on the substructure at their appropriate levels before insertion. The substructure thus supports the superstructure as it is inserted, and, when such supporting means as referred to above is provided, the supporting means can be used to maintain correct elevation of the superstructure as it is inserted and ensure that it takes up its correct position.

When the superstructure is to be inserted using a mining technique, one or more headings beneath the installation extending along and adjacent to the path of insertion are advantageously formed prior to, or during, insertion of the superstructure. The heading or headings permit access to the leading end of the superstructure as it is inserted and allow removal of spoil by, for example, conveyor means situated in the headings. Such headings may be lined, for example, with timber. The headings are advantageously so positioned that they are removed during excavation for the substructure. The superstructure is preferably provided with cutting means, such as a cutting blade arrangement, at its leading end, which also serves to accommodate one or more operators for the required excavation. If the superstructure is provided with one or more forwardly extending extension members before insertion, then the cutting means may be secured to the leading end of those extension members.

The superstructure and the substructure may each be pre-fabricated and transported to the site of the installation but, generally, they are constructed at the site. They may each be constructed from reinforced or prestressed concrete (and this will normally be the case) but in certain circumstances the superstructure, and even the substructure, may be constructed mainly from steel. It may, for example, be practicable and advantageous to arrange that the superstructure is made of steel and is lowered into position using an open cut method as described above.

The superstructure and the substructure may each comprise a plurality of units for insertion end to end. Such units may be urged into position either by applying a load to each unit in turn or by assembling the units end to end and applying a load to the rear of the rearmost unit. Thus, the superstructure may comprise a plurality of substantially flat roof units and the substructure may comprise a plurality of units of substantially U-shaped cross-section. The lengths of the units of each of the superstructure and substructure need not be the same, and the lengths of the units of the superstructure are advantageously not the same as the lengths of the units of the substructure so that a join between units of the superstructure does not occur directly over a join between units of the substructure.

One or more further structures, each comprising a superstructure and a substructure, may be inserted into the ground in accordance with the method of the invention, and two or more of the structures may be inserted side by side. In such a case, a first structure may be inserted completely into position before a second structure is inserted into the ground, or the structures may be inserted into the ground together. When two or more such structures are to be inserted, it is generally preferred to insert, in succession, each of the superstructures and then each of the substructures.

Advantageously, the superstructure (except when it is lowered into position), and, preferably, the substructure, is provided with means for reducing drag of the ground immediately adjacent to it on insertion. The or each superstructure and/or substructure is advantageously inserted in a manner similar to that described and claimed in U.K. Patent No. 2 185 277. Thus, the superstructure and/or substructure is advantageously provided before insertion with a series of flexible elongate members of round cross-section so arranged that a portion of each elongate member extends from a position at or in the vicinity of the leading end of the superstructure and/or substructure to an anchorage where it is fixed with respect to the ground, and, as the superstructure and/or substructure is inserted, successive portions of each of the elongate members are drawn from the position at or in the vicinity of the leading end to extend along the surface of the superstructure and/or substructure between that surface and the ground and stationary with respect to the ground in such a manner that the elongate members lie adjacent, and substantially parallel, to one another.

In the case where the superstructure comprises a substantially flat roof portion with cutting means at its leading end, the elongate members may be arranged to extend from within the cutting means, where they may be wound in coils, to the anchorage. Alternatively, the superstructure may be formed with longitudinally-extending ducts within it to accommodate the elongate members before they are drawn to extend between the surface of the superstructure and the ground. When the superstructure is inserted while excavation is taking place using a mining technique, the series of elongate members is advantageously arranged to extend between at least the upper surface of the superstructure and the ground, and preferably one or more further series of elongate members is arranged to extend between the lower surface of the superstructure and the ground. In the case where the superstructure is urged into position after excavation using the open cut method, the series of elongate members is advantageously arranged to extend between the lower surface of the superstructure and the ground. In such a case, the elongate members need not be positioned within the cutting means or within ducts in the superstructure but may rest on the upper surface of the superstructure and be drawn to lie between the lower surface and the ground as the superstructure is inserted.

On insertion of the substructure into the ground, the series of elongate members is advantageously arranged to extend at least between the base of the substructure and the ground, and preferably one or more further series of elongate members is arranged to extend between each side of the sub-structure and the ground.

The provision of one or more series of elongate members can effectively increase the resistance to dragging of the ground immediately adjacent to the superstructure and the substructure, and facilitate their correct alignment. After insertion, the elongate members may be withdrawn.

The invention also provides a structure which comprises a superstructure and a substructure inserted into the ground in accordance with the method of the invention.

Two methods of forming a passageway through the ground in accordance with the invention will now be described, by way of example, with reference to the accompanying drawings, in which.

Figure 1:
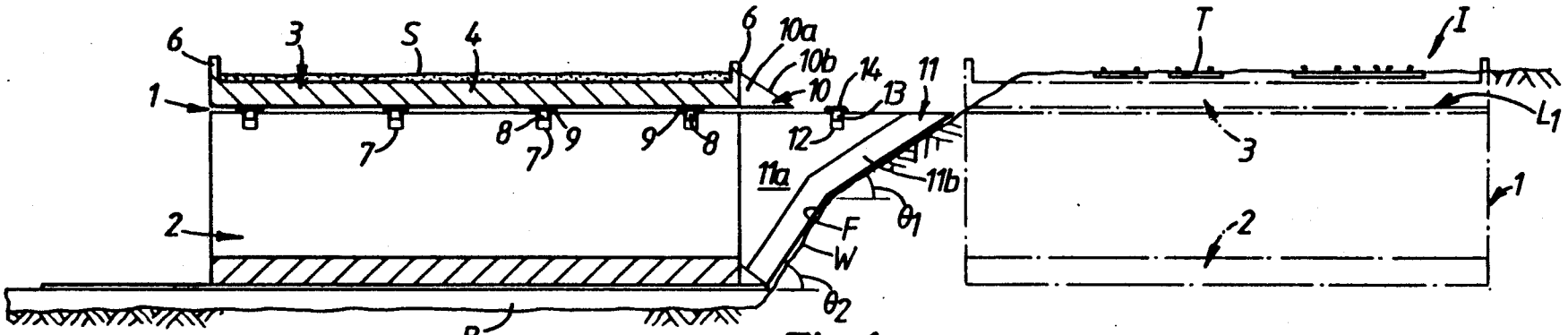
FIG. 1 shows diagrammatically a longitudinal section of a structure for insertion in accordance with a first form of the method of the invention.
Figure 2:
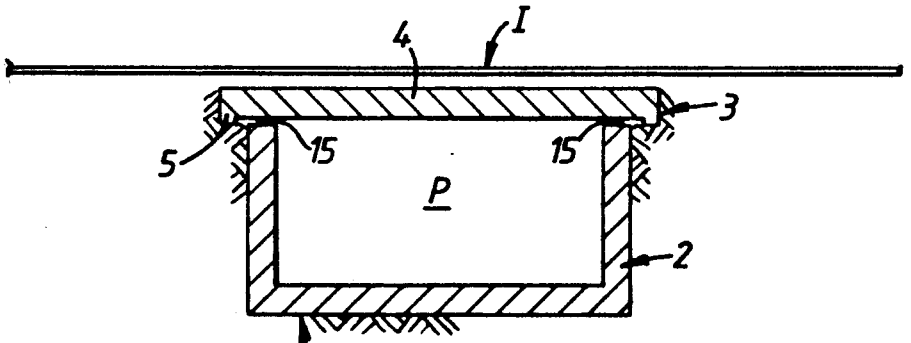
FIG. 2 shows diagrammatically a cross-section of a structure after insertion in accordance with the first form of the method of the invention.

Referring to the accompanying drawings, and initially to FIGS. 1 and 2 and the first form of the method of the invention, in order to provide a passageway in the form of an underpass at a shallow depth beneath an existing railway installation indicated generally by the reference letter I comprising railway track T, a working pit W is excavated on one side of the installation I. A reinforced concrete jacking base B is constructed in the working pit W keyed into the bedrock. A structure indicated generally by the reference numeral 1 comprising a substructure, indicated generally by the reference numeral 2, and a superstructure, indicated generally by the reference numeral 3, each of reinforced concrete, is then constructed by casting at the site on the base B. The substructure 2 is substantially U-shaped in cross-section as can be seen in FIG. 2. The superstructure 3 comprises a substantially flat deck or roof portion 4 provided with downwardly extending flanges 5 (see FIG. 2) extending along each side and upwardly extending flanges 6 extending along each end and arranged to retain ballast S on which new track can be laid. The substructure 2 is formed with a series of pockets 7 in the uppermost portion of its walls in which vertical mechanical or hydraulic jacks 8 provided with supporting skids 9 are placed to support the superstructure 3. The jacks 8 may be hand-operated individually, or linked together and operated remotely through a central control console (not shown). The superstructure 3 is provided with longitudinally-extending skid paths (not shown) set in it when it is cast, which bear on the supporting skids 9 and allow relative longitudinal sliding movement between the superstructure and the substructure. The skid paths are also sufficiently wide to allow for some relative transverse movement between the superstructure and substructure to provide a tolerance for misalignment on insertion.

Both the superstructure 3 and the substructure 2 are provided with cutting means 10 and 11, respectively. The cutting means 10 of the superstructure 3 comprises a cutting blade which extends along the lower edge of the leading end of the superstructure with side walls 10*a* having inclined cutting edges 10*b*. A series of apertures (not shown) are formed in the cutting means 10 and a series of flexible elongate rope members (not shown) are laid on top of the ballast S with their leading end portions extending through the apertures in the cutting means. The cutting means 11 of the substructure 2 consists of a cutting blade, which extends along the base of the substructure, and side walls 11*a* having inclined cutting edges 11*b*, The uppermost edge portions of the side walls 11*a* are also formed with pockets 12 (only one of which is shown) for further jacks 13 and skids 14. The base of the cutting means 11 is formed with apertures (not shown), similar to those in the cutting means 10, through which extend leading end portions of a series of flexible elongate rope members (not shown), the remainder of which lie within the interior of the substructure 2.

As an initial step, in which the superstructure 3 is to be inserted into the ground at a level $L_1$ using an "open-cut" method, a portion of the track T of the railway installation is removed and an area of ground (including ballast lying below the track T) excavated to a level just above the level $L_1$, the area being of sufficient size to accommodate the superstructure 3. The leading end portions of the rope members extending through the apertures in the cutting means 10 are anchored in the working pit W, and the superstructure 3 is urged axially in a substantially horizontal direction by hydraulic jacks (not shown) into position as shown in broken lines in FIG. 1. The small amount of ground remaining above the level $L_1$ is excavated as the superstructure 3 is urged forward so as to ensure that the level is correct. On insertion, the superstructure slides on the skids 9 and 14 and is supported partly (and to an increasing extent) on the ground at the level $L_1$ and partly (and to a decreasing extent) on the substructure 2. The jacks 8 and 13 are adjusted to maintain the superstructure 3 at its correct elevation during the insertion operation. As the superstructure 3 is moved forward, successive portions of the rope members are drawn from the upper surface of the superstructure through the apertures in the base of the cutting means 10 to extend underneath the superstructure between its lowermost surface and the ground so that they lie adjacent, and substantially parallel, to one another, and stationary relative to the ground. When the superstructure 3 is fully inserted to the position indicated in broken lines in FIG. 1, the rope members can be withdrawn. As the superstructure 3 is already carrying the ballast S, it is only necessary to lay new track upon the ballast for the railway to resume functioning. If it is practicable for new track to be laid upon the ballast before insertion of the superstructure 3, further time-saving can be achieved.

When the superstructure 3 is in position, the second step of inserting the substructure 2 is commenced (although insertion of the substructure 2 can be commenced before the superstructure 3 is fully inserted, the superstructure 3 and the substructure 2 being inserted at the same time but with the superstructure ahead of the substructure). The leading end portions of the rope members extending through the apertures in the cutting means 11 are anchored in the working pit W, and the substructure 2 is urged axially by hydraulic jacks (not shown) in a substantially horizontal direction into the ground. As the cutting means 11 cuts into the ground, the ground within the cutting means is excavated using machines such as 360° back-actor excavators, mining face F, which in this case has two angles of repose $\Theta_1$ and $\Theta_2$, respectively, being moved ahead of the substructure 2 beneath the superstructure 3. Depending on ground conditions, the substructure 2 may either be urged forward continuously (although not necessarily under a constant force) as the excavation is taking place, or, as is more often the case, intermittently, the insertion of the substructure 2 and the excavation being carried out in stages, the substructure being urged forward so that the cutting means 11 cuts into the ground, the ground within the cutting means being excavated, and the substructure urged forward again, that operation being repeated as many times as is required. The railway installation I immediately above the superstructure 3 is protected by the presence of the superstructure from disturbance during that excavation, and the superstructure provides stability to the ground beneath it, especially to the mining face F, isolating the ground beneath it from the effect of changes occurring in or on the ground and/or on the installation above it, for example, changes in loading caused by trains running on the track T, so that, with suitable ground conditions, no other support for the mining face need be provided. The excavation can thus be carried out relatively rapidly because it is possible for the entire mining face F to be free from other supports. As the substructure 2 is moved into position beneath the superstructure 3, the skid paths of the superstructure once again bear on the skids 9 and 14 and the jacks 8 and 13 allowing relative longitudinal sliding movement, although retaining means, such as props or struts, may be provided to bear against the superstructure to ensure it remains in its correct location. The jacks 8 and 13 are adjusted at intervals to maintain the superstructure 3 at the correct elevation. If any ground settlement has occurred after insertion of the superstructure 3 causing its elevation to change, that can also be rectified at the same time using the jacks 8 and 13.

In addition, as the substructure 2 is inserted into the ground, successive portions of the rope members are drawn from the interior of the substructure through the apertures in the base of the cutting means 11 to extend underneath the substructure between its lowermost surface and the ground. The rope members effectively separate the substructure 2 from the ground beneath it and help to prevent dragging of the ground immediately below the substructure as it is inserted. When the substructure 2 is fully inserted beneath the superstructure 3 into the position shown in broken lines in FIG. 1, the rope members can be removed. The cutting means 10 and 11 can also be recovered by excavating to the necessary depths on the other side of the installation I from the working pit W. The jacks 8 can be adjusted again to correct any change in the elevation of the superstructure 3 as a result of ground settlement caused by the insertion of the substructure 2. When no such further adjustments are required, the skids 9 and jacks 8 can be replaced by permanent bearings 15 as shown in FIG. 2. In this manner, a passageway P, bounded by the superstructure 3 and the substructure 2, is formed beneath the installation I.

In the form of the method described above, the superstructure 3 may, instead of being urged into position using hydraulic jacks, be lowered into position using a crane or cranes. In such a case, it would not be necessary to provide the superstructure 3 with the cutting means 10 or the elongate rope members. The superstructure 3 may also be constructed from steel rather than reinforced concrete.

Referring now to FIGS. 3 to 6, in the second form of the method of the invention, a pair of structures, indicated generally by the reference numerals 16 and 17, respectively, (see FIG. 6) are inserted into the ground side by side beneath an installation I' to form passageways $P_1$ and $P_2$, respectively. Each of the structures 16 and 17 comprises a superstructure 18 and 19, respectively, and a substructure 20 and 21, respectively. Each of the superstructures 18, 19 comprises a pair of substantially flat roof units (see units 18*a* and 18*b* in FIG. 5, the roof units of the superstructure 19 being similar) and each of the substructures 20, 21 also comprises a pair of units (see units 20*a* and 20*b* in broken lines in FIG. 5, the units of the substructure 21 being similar) of substantially U-shaped cross-section.

Figure 3:
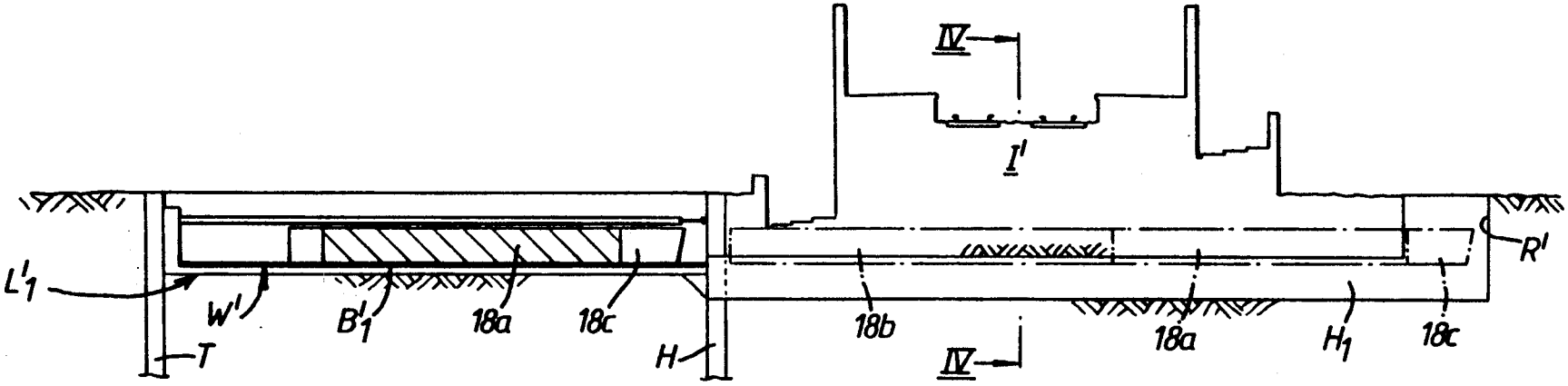
FIG. 3 shows diagrammatically a longitudinal section of a portion of a superstructure for insertion in accordance with a second form of the method of the invention.
Figure 4:
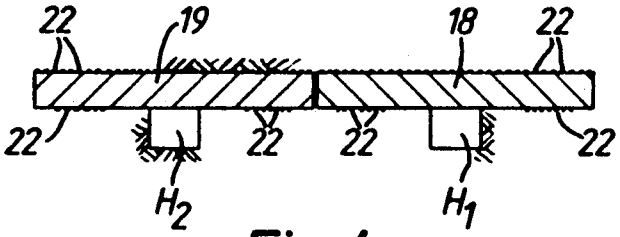
FIG. 4 shows diagrammatically a cross-section of a pair of superstructures taken along the line IV—IV in FIG. 3 immediately after insertion in accordance with the second form of the method of the invention.

Initially, to form the passageways $P_1$ and $P_2$ beneath the installation I', as shown in FIG. 3, a working pit W' is formed on one side of the installation I' by first forming a head wall H and a thrust wall T from steel piles driven vertically into the ground and then excavating to a first level indicated by an arrow $L'_1$ in FIG. 3. A jacking base $B'_1$ is formed on the floor of the pit. A reception pit R' is formed on the other side of the installation I', and two headings $H_1$ and $H_2$, respectively, (see FIG. 4) are excavated from the reception pit R' to the working pit W' so as to extend on the same level as, and parallel to, one another and substantially horizontally below the installation I'. The headings $H_1$ and $H_2$ are lined with timber supports (not shown).

The roof units 18*a* and 18*b* of the superstructure 18 are then formed from reinforced concrete by casting on the base $B'_1$, the second roof unit 18*b* being of a greater length than the first roof unit 18*a*. In the arrangement of FIGS. 3 to 6, the working pit W' is of such dimensions that the roof units 18*a* and 18*b* are cast alongside of each other, with the first unit 18*a* in position for insertion beneath the installation I' and the second roof unit 18*b* being cast so that its longitudinal axis is substantially parallel to that of the first roof unit 18*a*. The first roof unit 18*a* of the superstructure 18 is provided with cutting means 18*c* within which elongate rope members 22 (not shown in FIG. 3 but shown in FIG. 4) are coiled. The leading end portions of the rope members 22 extend through apertures (not shown) in the uppermost and lowermost surfaces of the cutting means 18*c* and are anchored in the working pit W'. The first roof unit 18*a* is then urged axially in a substantially horizontal direction into the ground by hydraulic jacks (not shown) acting on the rear end of the unit, the ground being excavated from within the cutting means 18*c* immediately ahead of the first roof unit as it is inserted by an operator or operators within the cutting means 18*c*. Depending on ground conditions, the first roof unit 18*a* may either be urged forward continuously (although not necessarily under a constant force) as the excavation within the cutting means 18*c* takes place, or intermittently in stages, the roof unit being urged forward so that the cutting means cuts into the ground, the ground within the cutting means being excavated, and the roof unit urged forward again, that operation being repeated as many times as is required. Spoil from the excavation is dropped onto a conveyor (not shown) within the heading $H_1$ for transportation to the reception pit R' and disposal. The heading $H_1$ also allows access to the cutting means 18*c* for the operators. As the first roof unit 18*a* is inserted, successive portions of the rope members 22 are drawn through the apertures in the cutting means 18*c* to lie between the uppermost surface of the first roof unit and the ground and also between the lowermost surface of the first roof unit and the ground on each side of the heading $H_1$. The operation continues until only the rearmost end portion of the first roof unit 18*a* still projects from the ground.

The second roof unit 18*b* of the superstructure 18 is then moved transversely in the working pit W' into position for insertion behind the first roof unit 18*a*. Hydraulic jacks (not shown) are arranged to act on the rear end of the second unit 18*b*, with intermediate hydraulic jacks (not shown) arranged between the first and second roof units 18*a* and 18*b*, respectively, to act on the first roof unit. The excavation ahead of the first unit 18*a* then continues either continuously or in stages as described above as the first and second units are together urged into the ground until they reach the position shown in broken lines in FIG. 3 beneath the installation I'. The elongate rope members 22 are long enough to extend over the entire length of the first and second units 18*a*, 18*b*, respectively, of the superstructure 18. When the first unit 18*a* reaches its final position, the intermediate hydraulic jacks between that unit and the unit 18*b* are removed. The hydraulic jacks acting on the rear of the unit 18*b* are then used to urge the second unit into contact with the first unit. The adjoining surfaces of the first and second units 18*a* and 18*b*, respectively, are preferably each so arranged that a keyed joint is formed between them, and means, such as, for example, tendons, may also be provided for maintaining the joint by urging the units together after removal of the hydraulic jacks. After insertion of both the first and second units 18*a* and 18*b*, the rope members 22 and the cutting means 18*c* can be removed. The operation is then repeated for the first and second roof units of the superstructure 19, which is inserted alongside of the superstructure 18, the heading $H_2$ being used for the removal of spoil from the excavation and access to the cutting means on the first unit of the superstructure 19.

Figure 5:
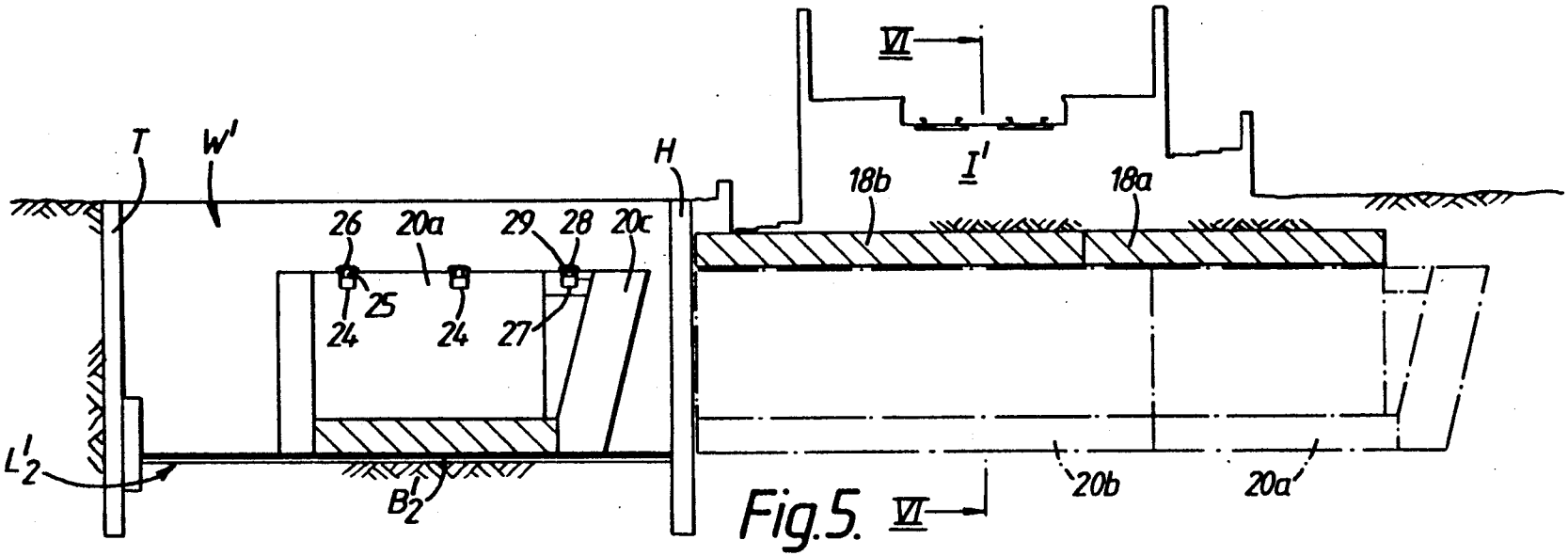
FIG. 5 shows diagrammatically a longitudinal section of a superstructure after insertion and of a portion of a substructure prior to insertion in accordance with the second form of the method of the invention.
Figure 6:
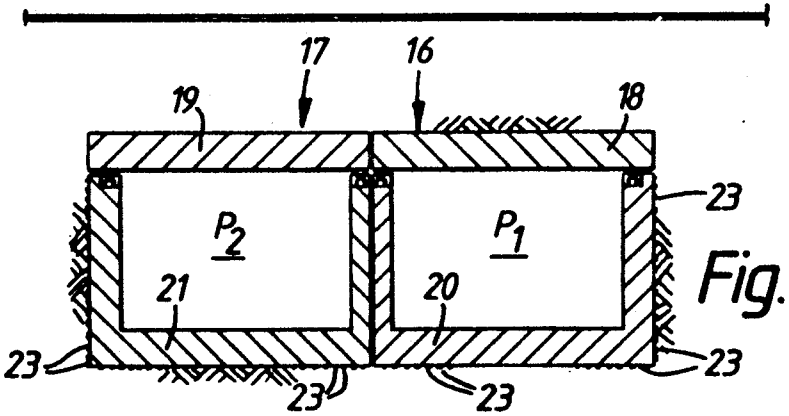
FIG. 6 shows diagrammatically a cross-section of a pair of structures taken along the line VI—VI in FIG. 5 immediately after insertion in accordance with the second method of the invention.

After the superstructures 18 and 19 are in position beneath the installation I', the jacking base $B'_1$ is removed. The working pit W' is excavated to a level $L'_2$ as shown in FIG. 5 and a new jacking base $B'_2$ is laid. The first and second units 20*a* and 20*b*, respectively, of the substructure 20 are formed from reinforced concrete by casting on the base $B'_2$. As with the roof units of the superstructures 18 and 19, the first and second units of the substructure 20 are cast alongside of each other with the first unit 20*a* in position for insertion beneath the superstructure 18 and the second unit 20*b* at the side of the first unit. The first substructure unit 20*a* is provided with a cutting means 20*c*. Rope members 23 (not shown in FIG. 5 but shown in FIG. 6) are supported inside the first unit 20*a* of the substructure 20, the leading end portions of the rope members extending through apertures (not shown) in the base and side walls of the cutting means 20*c* and being anchored in the working pit W' In the uppermost surfaces of the side walls of the first unit 20*a* of the substructure 20 pockets 24 are formed for vertical mechanical or hydraulic supporting jacks 25 and skids 26, and further pockets 27 are provided in the cutting means 20*c* with supporting jacks 28 and skids 29.

The first unit 20*a* of the substructure 20 is then urged in a manner similar to that in which the substructure 2 is inserted in the first method of the invention described above, either continuously or in stages, by hydraulic jacks (not shown) acting on the rear end of the unit into the ground beneath the superstructure 18, the ground within the cutting means 20*c* immediately ahead of the unit being excavated as it is inserted by a machine or machines such as 360° back-actor excavators situated within the cutting means. The superstructures 18 and 19 protect the installation I' from disturbance during excavation for the substructure 20. The superstructures 18 and 19 also serve to carry the weight of the ground and installation above them, so that, the ground directly beneath the superstructures, especially the mining face immediately ahead of the first unit 20*a* of the substructure 20, is substantially relieved of that weight. Furthermore, the superstructures 18 and 19 effectively isolate the ground beneath them from the effect of changes in loading caused by trains running on the installation I'. As the first unit 20*a* of the substructure 20 is inserted, successive portions of the rope members 23 are drawn through the apertures in the cutting means 20*c* to lie between the base of the unit and the ground and also between the side walls and the ground so as to reduce drag of the ground immediately around the unit. Skid paths (not shown) on the underside of the superstructure 18 bear on the skids 26, 29 and the supporting jacks 25, 28, which allow relative longitudinal sliding movement and permit adjustment to maintain the superstructure 18 at its correct elevation. The first unit 20*a* of the substructure 20 is urged forward until only its rearmost end still projects from the ground.

The second unit 20*b* of the substructure 20 is then moved transversely in the working pit W' into position for insertion behind the first unit 20*a*. Hydraulic jacks (not shown) are arranged to act on the rear end of the second unit 20*b*, with intermediate hydraulic jacks (not shown) arranged between the first and second units 20*a* and 20*b*, respectively, to act on the first unit 20*a*. The excavation ahead of the first unit 20*a* then continues either continuously or in stages as the first and second units 20*a* and 20*b* are urged together into the ground until they reach the position shown in broken lines in FIG. 5 beneath the installation I', the heading H being removed during the excavation process. The elongate rope members 23 are long enough to extend over the entire lengths of the first and second units of the substructure 20. As will be seen in FIG. 5, the length of the first unit 20*a* of the substructure 20 is less than that of the first unit of the superstructure 18, and the second unit 20*b* of the substructure is longer than the second unit of the superstructure 18*b* so that joins between units of the superstructure do not occur directly over joins between units of the substructure. After insertion of both the first and second units of the substructure 20, the hydraulic jacks that acted on the rear of the units and the rope members 23 are removed.

The operation is then repeated for the substructure 21, which is inserted alongside the substructure 20, beneath the superstructure 19, thus forming the two parallel passageways $P_1$ and $P_2$.

As with the method described with reference to FIGS. 1 and 2, the supporting jacks 25 and 28 can be adjusted during or after insertion of the substructures 20 and 21 to correct the elevation of the superstructures 18 and 19 should it be necessary because of ground settlement or for any other reason. When no further adjustment is required, the jacks 25, 28 and the skids 26, 29 can be replaced with permanent bearings. The cutting means of the substructures 20 and 21 can also be removed by excavating to recover them.

Although in the method of the invention as described with reference to FIGS. 3 to 6 above, the working pit W' is of such dimensions that the first and second units of each of the superstructures and substructures have to be cast alongside of one another, the working pit can be formed, where other circumstances permit, so that the superstructures and substructures can be cast in positions in which each of the first units is arranged co-axially with its associated second unit.

The second method of the invention as described above can be carried out without any interruption to the functioning of the installation I' although it may be necessary to impose some speed restriction.

If further protection of the ground is required, for example, the area of ground immediately ahead of the final position of the substructures 20 and 21 into which the cutting means will project, the superstructures 18 and 19 may be provided with one or more extension members that extend forwardly or rearwardly of the superstructures. Such extension members can be attached before or after insertion of the superstructures 18, 19 and can be removed after insertion of the substructures 20 21. The or each extension member may be in the form of one or more beams secured to the superstructures.

The superstructure 3 in the first form of the method described above may also be provided with such extension members.

What I claim is:

1. A method of forming a passageway through the ground by inserting into the ground a structure which comprises a superstructure and a substructure, which together define the passageway, the method inclining:

(a) inserting the superstructure into position in the ground;

(b) urging the substrucure to move it into the ground beneath the superstructure, the substructure moving in the direction in which the passageway extends;

(c) excavating the ground immediately ahead of the substructure as it is inserted so as to allow said movement of the substructure and excavating so that a region bounded by the superstructure and the substructure is emptied to provide the passageway through the ground; and (d) at least during the insertion of the substructure into the ground beneath the superstructure, providing means for supporting the superstructure on the substructure, which supporting means allow relative longitudinal sliding movement between the substructure and the superstructure.

2. A method as claimed in claim 1, wherein the supporting means is adjustable to vary the elevation of the superstructure.

3. A method as claimed in claim 2, wherein a working pit is initially formed on one side of an installation to accommodate the substructure and the superstructure supported on the substructure at the levels at which they are to be inserted into the ground and the supporting means is used to maintain correct elevation of the superstructure as it is inserted.

4. A method of forming a passageway through the ground by inserted into the ground a structure which comprises a superstructure and a substructure, which together define the passageway, the method including:

(a) forming one or more headings through the ground extending in the direction of the passageway;

(b) during or after formation of said one or more headings, inserting the superstructure into position in the ground adjacent to said one or more headings while the ground is being excavated for the superstructure;

(c) urging the substructure to move it into the ground beneath the superstructure, the substructure moving in the direction in which the passageway extends; and (d) excavating the ground immediately ahead of the substructure as it is inserted so as to allow said movement of the substructure and excavating so that a region bounded by the superstructure and the substructure is emptied to provided the passageway through the ground.

5. A method as claimed in claim 4, wherein, during excavation for the superstructure, spoil is deposited into the headings and removed by conveyor means situated in the headings.

6. A method as claimed in claim 4, wherein the headings are so positioned that they are removed during excavation for the substructure.

7. A method of forming a passageway through the ground by inserting into the ground a structure which comprises a superstructure and a substructure, which together define the passageway, the method including:

(a) inserting the superstructure by urging it into position in the ground;

(b) urging the substructure to move it into the ground beneath the superstructure, the substructure moving in the direction in which the passageway extends;

(c) excavating the ground immediately ahead of the substructure as it is inserted so as to allow said movement of the substructure and excavating so that a region bounded by the superstructure and the substructure is emptied to provide the passageway through the ground; and (d) providing the superstructure and/or substructure before insertion with a series of flexible elongate members of round cross-section so arranged that a position of each elongate member extends from a position at or in the vicinity of the leading end of the superstructure and/or substructure to an anchorage where it is fixed with respect to the ground, and, as the superstructure and/or substructure is inserted, successive portions of each of the elongate members are drawn from the position at or in the vicinity of the leading end to extend along the surface of the superstructure and/or substructure between that surface and the ground and stationary with respect to the ground in such a manner that the elongate members lie adjacent, and substantially parallel, to one another.

8. A method as claimed in claim 7, wherein the superstructure comprises a substantially flat roof portion with cutting means at its leading end, and each of the flexible elongate members is arranged to extend from within the cutting means to the anchorage.

9. A method as claimed in claim 7, wherein the superstructure is formed with longitudinally-extending ducts within it to accommodate the elongate members before they are drawn to extend between the surface of the superstructure and the ground.

10. A method as claimed in claim 7, wherein the superstructure is urged into position after the ground has been excavated and the series of flexible elongate members rests on the upper surface of the superstructure and is drawn to lie between the lower surface and the ground as the superstructure is inserted.

11. A method of forming a passageway through the ground by inserting into the ground a structure which comprises a superstructure and a substructure, which together define the passageway, the method including:

(a) inserting the superstructure into position in the ground by urging it to move into the ground in a direction in which the passageway extends, and excavating the ground immediately ahead of the superstructure as it is inserted so as to allow the said movement;

(b) urging the substructure to move it into the ground beneath the superstructure, the substructure moving in the direction in which the passageway extends; and (c) excavating the ground immediately ahead of the substructure as the substructure is inserted so as to allow said movement of the substructure and excavating so that a region bounded by the superstructure and the substructure is emptied to provide the passageway through the ground.

12. A method as claimed in claim 11, wherein the substructure is urged into the ground while the superstructure is being urged into the ground but with the superstructure ahead of the substructure.

13. A method of forming a passageway through the ground by inserting into the ground a structure which comprises a superstructure and a substructure, which together define the passageway, the method including:

(a) forming a working pit on one side of an installation to accommodate the substructure and the superstructure supported on the substructure at the levels at which they are to be inserted into the ground;

(b) inserting the superstructure into position in the ground;

(c) urging the substructure to move it into the ground beneath the superstructure, the substructure moving in the direction in which the passageway extends; and (d) excavating the ground immediately ahead of the substructure as the substructure is inserted so as to allow said movement of the substructure and excavating so that a region bounded by the superstructure and the substructure is emptied to provide the passageway through the ground.

* * * * *

UNITED STATES PATENT AND TRADEMARK OFFICE

CERTIFICATE OF CORRECTION

PATENT NO. : 5,129,760

DATED : July 14, 1992

INVENTOR(S) : John Wilfred Thomas Ropkins

It is certified that error appears in the above-identified patent and that said Letters Patent is hereby corrected as shown below:

Column 6, line 26, change "open cut" to --open-cut--;

Column 7, line 58, change "11b," to --11b.--;

Column 11, line 38, change "W'" to --W'.--;

Column 12, line 20, change "H" to --$H_1$--;

Column 13, line 2, change "20 21." to --20, 21.--;

line 12, change "inclining" to --including--;

Column 14, line 20, change "position" to --portion--.

Signed and Sealed this

Twenty-eighth Day of September, 1993

Bruce Lehman

*Attest:*

BRUCE LEHMAN

*Attesting Officer*

*Commissioner of Patents and Trademarks*